United States Patent [19]

Attwood

[11] Patent Number: 4,596,633

[45] Date of Patent: Jun. 24, 1986

[54] SURFACE TREATMENT OF PAPER AND PAPERBOARD

[75] Inventor: Brian W. Attwood, Bristol, England

[73] Assignee: The Black Clawson Company, Middletown, Ohio

[21] Appl. No.: 674,107

[22] Filed: Nov. 21, 1984

Related U.S. Application Data

[63] Continuation-in-part of Ser. No. 598,950, Apr. 11, 1984, abandoned.

[30] Foreign Application Priority Data

Oct. 24, 1983 [GB] United Kingdom ..... 8328354

[51] Int. Cl.[4] ..... D21F 11/00

[52] U.S. Cl. ..... 162/206; 100/153; 100/162 R

[58] Field of Search ..... 162/201, 202, 205, 206, 162/207, 192, 359, 360, 361; 100/152, 153, 162 R

[56] References Cited

U.S. PATENT DOCUMENTS

| | | | |
|---|---|---|---|
| 2,251,890 | 8/1941 | Montgomery | 162/206 |
| 3,024,129 | 3/1962 | Brundige | 162/206 |
| 3,124,504 | 3/1964 | Mahoney et al. | 162/206 |
| 3,149,025 | 9/1964 | Dickens | 162/359 |
| 3,319,352 | 5/1967 | Haigh | 162/206 |
| 3,362,869 | 1/1968 | Welsh | 162/206 |
| 3,938,261 | 2/1976 | Anderson | 162/206 |

*Primary Examiner*—Peter Chin

*Attorney, Agent, or Firm*—Biebel, French & Nauman

[57] ABSTRACT

Paper and paperboard which have been thoroughly dried but not calendered is provided with a smooth surface by rewetting a thin layer (5% to 10% of the thickness) along the surface and then pressing the resulting damp surface against a substantial portion of the surface of a heated dryer drum or other smooth-surfaced cylinder. This technique provides the web with a surface comparable in smoothness with what can be obtained by calendering but without the degree of compaction which occurs in calendering, due to the fact that with the major portion of the web dried, it is highly resistant to such compaction. The same method steps can be applied subsequently to the reverse side of the web to provide it with two smooth surfaces. It is also possible to forego the rewetting step if the initial drying of the web is unsymmetrical so that one surface remains wetter than the remaining portion of the web.

10 Claims, 4 Drawing Figures

SURFACE TREATMENT OF PAPER AND PAPERBOARD

CROSS-REFERENCE TO COPENDING APPLICATION

This application is a continuation-in-part of application Ser. No. 598,950, filed Apr. 11, 1984, now abandoned.

BACKGROUND OF THE INVENTION

In the production of paper and paperboard, it is very often an objective to produce as smooth a finish as possible on at least one surface of the web, but at the same time to minimize compaction or densification of the web as a whole, especially in the case of paperboard.

Conventional practice has employed a variety of techniques and equipment in an effort to accomplish this result, including various forms of calendering, machine glazing by means of an M.G. cylinder or Yankee dryer, the use of a nip roll on a dryer roll in the dryer section, and a breaker stack. All of these techniques and equipment have some disadvantages.

More specifically, the nip pressures are so high in a calender stack, due to the weight and number of its component rolls, that substantial densification of the web is unavoidable. Machine glazing is more satisfactory from the standpoint of less densification of the web as a whole, but the cylinders used therefor are large and expensive, e.g. 15 to 20 feet in diameter, they are difficult to operate, and they require particular operating limitations related to the drying of the web which render their use impractical or uneconomic.

It is accordingly a primary object of the present invention to provide improved and simple methods and apparatus for the treatment of webs of paper and paperboard which will produce a satisfactorily smooth surface on one or both sides of the web with less densification than can be achieved by prior practice.

SUMMARY OF THE INVENTION

The treatment of the invention is applied initially to a web of paper or paperboard which has been dried, to a solids content of substantially 80% or more, throughout the major portion of its thickness including one surface, but which has a thin layer adjacent the other surface, and constituting a minor portion of its total thickness, of a substantially lower solids content, i.e. it is considerably wetter than the remainder of the web. These desired characteristics can be obtained by rewetting one surface of a web which has already been dried to an essentially uniform high consistency, or the web may be subjected to preferential or unsymmetrical drying which leaves one surface wetter than the major portion of the web, as by presenting only one surface to the dryer drums.

The next step in the practice of the invention is to present the wetted surface of the web to a smooth dryer drum or other heated smooth-surfaced cylinder while pressing the web into a condition of intimate contact between its wet surface and the surface of the heated cylinder. The desired engagement between the web surface and the heated cylinder is preferably established and maintained without applying so much pressure to a limited area of the web as to effect significant reduction in its thickness as a whole.

The invention to a considerable degree depends upon certain principles including that when the web has been dried to an essentially uniform solids content of greater than 75%, and preferably to a higher consistency in the range of 80–95%, it has correspondingly greater strength and resistance to compaction than at lower consistencies. On the other hand, a web of that degree of dryness is also highly resistant to change in its surface characteristics, because the layers adjacent the surface are likely to be even more highly dried than the interior of the web, since they have been directly exposed to the high surface temperature of the dryer drums and to the air circulating in the dryer section.

In accordance with the invention, however, it has been found that when a thin surface layer of a thoroughly dry but uncalendered web is rewetted, the fibers therein can be rearranged to a high state of smoothness, but the dry condition of the remainder of the sheet enables it to resist further compaction, particularly under the moderate pressure conditions applied thereto in the practice of this invention. The effect of the invention is therefore to produce notably improved surface smoothness with minimum reduction in the thickness of the web, and in fact also to develop increased brusting strength and stiffness in the web.

As an illustration of experimental results of the practice of the invention, samples of board made from waste paper and having an initial thickness of 0.32 inch, a surface smoothness of 1,800 Bendtsen units and a consistency of 70% were treated according to the invention, and after such treatment, their thickness had been decreased only very slightly, to 0.030 inch, but their smoothness had greatly improved, to an average of 305 units.

A sample of the same board treated by conventional calendering had a smoothness of 180 units, but its thickness had been reduced to 0.0255 inch, namely a reduction in thickness of more than 20% or more than three times the compaction produced by treatment in accordance with the invention. In addition, the samples treated in accordance with the invention had substantially higher bursting strength, measured as 945 kPa as compared with 750 hPa for the calendered sheet, as well as substantially greater stiffness.

Recent experimentation has established that for preferred results, the invention should be applied to a web which has been dried to an essentially uniform solids content in the range of 80% to 95%, after which a thin layer on one surface of such web of a thickness consisting of 5% to 10% of the total thickness of the web, is rewetted to a solids content in the range of 50–70%. It is important that the water not be absorbed too far into the sheet, and preferably should not penetrate further than the first 10% of the total thickness of the web. This result is achieved by proper control of the rate at which water is applied and by having the rewetting take place immediately ahead of the first press nip through which the rewetted web passes.

In carrying out the surface-smoothing step of the invention on a heated cylinder as briefly described above, it may be possible to establish and maintain the desired intimate contact between the wet surface of the web and the cylinder by maintaining the web itself under some tension, but it has generally been found desirable to augment that pressure by other means, including particularly one or more pressure nips between a pressure roll or rolls and the heated cylinder, an endless belt, such as a wire or felt, which is maintained under tension in overlying relation with the portion of the web which wraps the heated cylnder, or a combination of such a supporting belt and one or more pressure nips.

In any event, this step of the invention does not require pressures comparable to the nip pressures developed in calenders, and the range of nip pressures which have been found to produce satisfactory results in testing of the use of the invention is substantially 50–700 lbs. per linear inch where the nip width is in the range of 0.5 to 3.0 inches. Optimum conditions may require preliminary testing in accordance with the principles of the invention as described above and also hereinafter in connection with the drawings.

While the invention appears to have its greatest application to the provision of a smooth surface on one side of a web of paperboard such for example in the production of box board which can be utilized with one surface relatively unfinished, it can also be employed to finish both surfaces of the web. For example, if it is desired to have two smooth surfaces, the steps of the invention as summarized above can be repeated for the secoond surface of the web, namely the rewetting and pressure drying steps.

In another extension of the invention, it is possible to create a textured surface on one side of the web while the other side is being smoothed in accordance with the primary embodiment of the invention. For this purpose, the web is directly supported during its passage around the heated cylinder by an endless band having a textured outer surface which is brought into pressure engagement with the opposed surface of the web during its wrapped engagement with the heated cylinder. The pressure of the textured band against the paperboard web may be created initially by its own tension, but this may be augmented by an additional tensioned endless belt and/or one or more pressure roll nips against the heated cylinder.

It should also be understood that when the web is rewetted in accordance with the invention, the rewetting may be by water alone or by various acqueous solutions or suspensions of materials capable of giving the treated surface particular desired characteristics, e.g. starch, CMC, etc. It should also be understood that after treatment according to the invention, the web may be subjected to other treatments such as coating, brushing and light calendering.

DETAILED DESCRIPTION OF THE PREFERRED EMBODIMENTS

Figure 1:
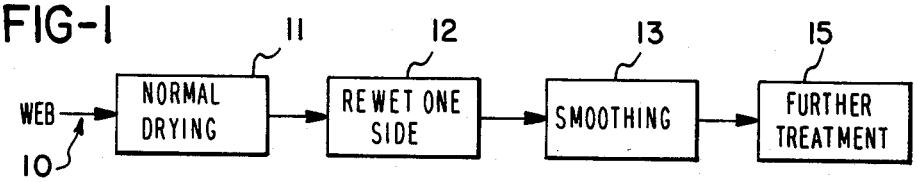
FIG. 1 is a block diagram illustrating the method of the invention as applied to a web of paper of paperboard which requires surface rewetting.

The diagrammatic view in FIG. 1 shows the newly formed web 10 of paper or paperboard as undergoing a normal drying treatment, represented by the box 11, which will increase its consistency to a range of 70–85% solids, a typical example being approximately 80%. The surface of the web to be smoothed is then rewetted in a wetting stage 12, using conventional means such as roll application, rotary brushes or sprays.

The rewetted web is then subjected to smoothing at 13, as described above and also below in connection with the several showings in the drawing of specific apparatus for this purpose. The final treatment stage 15 represents any desired further treatment as also discussed above, including smoothing of the back side of the web by repeating the rewetting and smoothing steps represented by boxes 12 and 13, etc.

In the remaining views in the drawing, the element 20 represents a heated cylinder, such as a dryer drum, which preferably has a highly polished surface, and the web 10 is assumed to have a thin layer adjacent its upper surface which is of substantially lower consistency than the rest of the web, as the result of either preferential drying or rewetting as already described.

Figure 2:
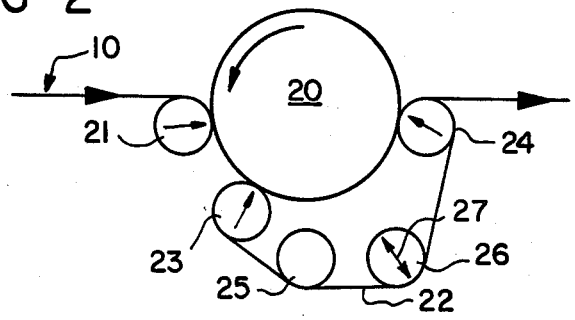
FIGS. 2–4 are line diagrams illustrating alternative arrangements of apparatus for carrying out the process of the invention.

FIG. 2 represents a preferred form of the practice of the invention wherein the web 10 first engages the cylinder 20 when it passes through a bare pressure nip between the cylinder 20 and a pressure roll 21. In addition, a major part of the portion of the web which wraps the cylinder 20 is also held in pressure engagement with the cylinder by an endless belt 22, which may be similar to a dryer felt but preferably is a non-absorbent foraminous fabric belt such as a woven plastic or metal belt of the type used as a paper machine forming wire. The belt 22 is supported by a plurality of rollers, shown as pressure rollers 23 and 24, an idler roller 25 and a tensioning roller 26 which is mounted for movement, s indicated by the arrow 27, for the purpose of establishing and maintaining desired high linear tension in the belt 22.

Under some circumstances, as already pointed out, adequate pressure engagement between the web 10 and cylinder 20 can be effected by maintaining the web itself under sufficient tension, created by a reel or other means located downstream of the cylinder 20. Similarly, the desired pressure engagement may be sufficiently augmented by the tension in the belt 22, in which case the rollers 23 and 24 would be mounted in spaced relation with the cylinder 20, and the pressure roll 21 would be spaced from the cylinder 20 to act simply as a guide roll. Preferred results, however, in the testing of the invention thus far have been obtained with the combination of the lead-in bare pressure nip followed by the additional pressure nips at the rolls 23 and 24, in which the web 10 is cushioned by the belt 22, all as illustrated in FIG. 2.

Figure 3:
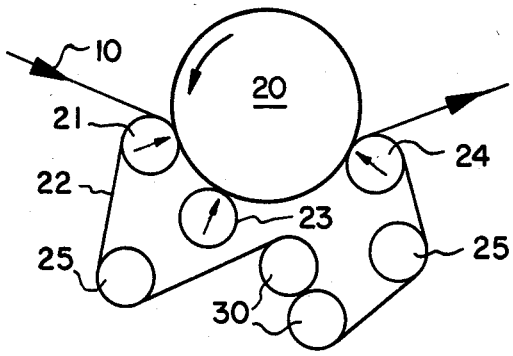

The arrangement in FIG. 3 is similar to that of FIG. 2, and employs the same reference characters, but the belt 22 is extended to pass through all three pressure nips, there are two idler rolls 25, and there is a different arrangement of tensioning rolls 30. The mode of operation of this arrangement of apparatus is otherwise essentially the same as described in connection with FIG. 1, except that the web is cushioned by the belt 22 in each of the pressure nips so that the effective width of each nip is wider than at the bare pressure nip in FIG. 2.

Figure 4:
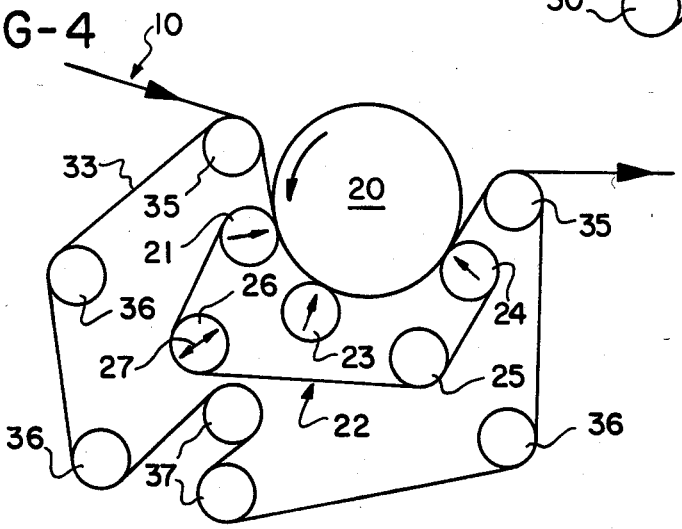

FIG. 4 illustrates a modified arrangement of apparatus for the purpose of texturing one side of the web 10 while the other side is being smoothed. The endless band 33 in FIG. 4, which may be a felt or textile band, has a desired texture on its outer surface, and it is supported by guide rolls 35, idler rolls 36 and tensioning rolls 37 so that it engages and overlies the entire portion of the web 10 which wraps the heated cylinder 20.

The endless belt 22 in FIG. 4 is arranged in substantially the same way as in FIG. 3, by means of pressure rolls 21, 23 and 24, and a tensioning roll 26, except that the belt 22 also wraps the pressure roll 21 so that the web 10, the belt 22 and the band 33 all pass through the nip formed by roll 21 and cylinder 20. Thus the web 10 is pressed against the cylinder 20 by its own tension, the tension of belt 22 and band 33, and the pressure nips which each of rolls 21, 23 and 24 forms with cylinder 20.

As previously noted, it is important that the rewetting be controlled so that for optimum results, a web which has been dried to an essentially uniform solids content in the preferred range of 80% to 95% be rewetted to the extent of penetration of no more than about 10% of its total thickness, with the rewetting being to a solids content in the range of 50% to 70%. These results can be obtained by applying a quantity of water in the range of $0.2\times10^{-6}$ to $0.6\times10^{-6}$ gallons per minute, per inch of web width, per foot per minute machine speed, per pound per 1,000 sq. ft. bone dry basis weight. For example, a 75 lb. per 1,000 sq. ft. air dry sheet would be equivalent to 69.75 lb. per 1,000 sq. ft. bone dry sheet, and for a web width of 150 inches and machine speed of 1,000 FPM, rewetting according to the invention would require 2.1 to 6.3 gallons per minute.

This range is relatively broad because of the correspondingly broad range of water absorptivity of the different types of web for which treatment in accordance with the invention is most desirable. Accordingly, the optimum quantity of water should be determined by trial of the particular grade of sheet to be treated.

More specifically, where the process of the invention is used in conjunction with conventional calendering, proper treatment in accordance with the invention should result in an improvement in surface smoothness of the order of 12% or more with substantially no change in caliper. For example, in one pilot machine experiment with milk carton board having a basis weight of 90 lbs. per 1,000 sq. ft., the Sheffield smoothness improved from 330 to 290 while maintaining the normal production caliper of 23 mils after treatment in accordance with the invention wherein water was applied at the rate of $0.3\times10^{-6}$ gallons per minutes per inch of web width, per foot per minute machine speed, per pound per 1,000 sq. ft. dry basis weight.

The parameters for the several conditions involved in the practice of the invention are relatively imprecise, and provide for substantial variation in the practice of the invention depending upon the characteristics of the particular web being treated and the results to be achieved. For example, the belt 22 should be capable of withstanding an applied tension of 10–50 pounds per linear inch, and as previously noted, satisfactory results have been obtained utilizing a belt equivalent to a paper machine forming wire woven from metal wire or plastic filament material.

The cylinder or cylinders—one or more additional stations like those in FIGS. 2 and 3 could be added if needed—on which the surfacing treatment is carried out preferably may have a diameter in the range of 4 to 7 feet, and may be heated to a surface temperature in the range from 250° to 600° F. Typical nip pressures utilized in the process of the invention are in the range from 50 to 700 pounds per linear inch, with nip widths in the range of 0.5 to 3.0 inches.

As a more specific example, the waste paper board described above was treated on a cylinder having a surface temperature of 285° F., and was passed through two pressure nips wherein the pressure was 200 pli on a supporting belt tensioned to 30 pli. It is significant that in addition to the other characteristics of that web as compared with calendered samples of the same material, there was no difference in the ply bond as between the web treated in accordance with the invention and the same bare web given the standard calendering treatment.

While the methods herein described constitute preferred embodiments of this invention, it is to be understood that the invention is not limited to these precise methods of apparatus, and that changes may be made therein without departing from the scope of the invention, which is defined in the appended claims.

What is claimed is:

1. The method of producing a smooth surface on a web of paper or paperboard while minimizing the compaction thereof which comprises the steps of:

(a) providing an unfinished web of paper or paperboard having a solids content in the range of at least substantially 80% throughout the major portion of the thickness thereof measured from one surface thereof but having a lower solids content in the range of substantially 50% to 70% in a layer including the other surface thereof and constituting not more than substantially 5% to 10% of the thickness thereof, (b) guiding said web into partially wrapping relation with a heated cylinder with said lower solids content surface in contact with said cylinder, and (c) pressing said web into intimately contacting relation with said cylinder over the entire wrapped portion thereof.

2. The method of producing a smooth surface on a web of paper of paperboard while minimizing the compaction thereof which comprises the steps of:

(a) providing an unfinished web of paper or paperboard having a solids content in the range of at least substantially 80% throughout the entire thickness thereof, (b) applying an aqueous liquid to a solids content in the range of substantially 50% to 70% to one surface of said web at a rate sufficient to rewet only a layer of said web adjacent said one surface and constituting not more than substantially 5% to 10% of the thickness of said web, (c) guiding said rewetted web into partially wrapping relation with a heated cylinder and with said rewetted surface in contact with said cylinder, and (d) pressing said web into intimately contacting relation with said cylinder over the entire wrapped portion thereof.

3. The method defined in claim 2 wherein said liquid applying a pressing steps are controlled to effect substantially no reduction in the caliper of said web.

4. The method defined in claim 2 wherein said pressing step is carried out substantially immediately after said liquid-applying step, and wherein said liquid is applied at the rate of 0.2 times $10^{-6}$ gallons per minute, per inch of web width, per foot per minute web speed, per pound per 1000 square feet basis weight of said web.

5. The method defined in claim 1 wherein said pressing step is carried out by maintaining said web under tension.

6. The method defined in claim 1 wherein said pressing step is carried out by means of an endless belt which is guided into overlying relation with at least a part of said cylinder-wrapping portion of said web and is maintained under tension creating pressure against said cylinder.

7. The method defined in claim 1 wherein said pressing step is carried out by means of at least one pressure roll forming a bare pressure nip with said cylinder through which said web passes.

8. The method defined in claim 6 which includes the step of augmenting the pressure of said belt against said cylinder by a plurality of pressure rolls forming pressure nips with said cylinder through which said belt passes.

9. The method defined in claim 1 wherein said pressing step is carried out by means of a pressure roll forming a bare pressure nip with said cylinder through which said web passes, and by means of an endless belt which is guided into overlying relation with a part of said cylinder-wrapping portion of said web and is maintained under creating pressure under said cylinder.

10. The method defined in claim 1 further comprising the steps of:

(a) guiding an endless band having a textured surface into overlying relation with at least a part of said cylinder-wrapping portion of said web, and (b) maintaining said band in pressure engagement with the outer surface of said part of said cylinder-wrapping portion of said web to emboss a corresponding textured surface thereon.

* * * * *

UNITED STATES PATENT AND TRADEMARK OFFICE

CERTIFICATE OF CORRECTION

PATENT NO. : 4,596,633

DATED : June 24, 1986

INVENTOR(S) : Brian W. Attwood

It is certified that error appears in the above-identified patent and that said Letters Patent is hereby corrected as shown below:

Column 8, line 2, after "under", first occurrence, insert --tension--.

Signed and Sealed this

Eighteenth Day of November, 1986

*Attest:*

DONALD J. QUIGG

*Attesting Officer* *Commissioner of Patents and Trademarks*